US005335527A

United States Patent [19]

Nagai et al.

[11] Patent Number: 5,335,527

[45] Date of Patent: Aug. 9, 1994

[54] METHOD AND APPARATUS FOR MANUFACTURING A COMPOSITE METAL WIRE BY USING A TWO WHEEL TYPE CONTINUOUS EXTRUSION APPARATUS

[75] Inventors: Masahiro Nagai, Ibaraki, Japan; Kazuo Abe, Dubrin, Calif.; Tadashi Nireki, Ibaraki, Japan; Hisanobu Yamagishi, Ibaraki, Japan; Yasuhiko Miyake, Ibaraki, Japan

[73] Assignee: Hitachi Cable, Ltd., Tokyo, Japan

[21] Appl. No.: 978,932

[22] Filed: Nov. 20, 1992

[51] Int. Cl.[5] ..... B21C 23/24

[52] U.S. Cl. ..... 72/262; 72/268; 72/259

[58] Field of Search ..... 72/259, 262, 268

[56] References Cited

U.S. PATENT DOCUMENTS

| | | | |
|---|---|---|---|
| 3,302,440 | 2/1967 | Seidel et al. | 72/268 |
| 4,208,898 | 6/1980 | Ames et al. | 72/262 |
| 5,000,025 | 3/1991 | Beekel | 72/262 |

FOREIGN PATENT DOCUMENTS

| | | | |
|---|---|---|---|
| 233064 | 8/1987 | European Pat. Off. . | |
| 0897946 | 11/1953 | Fed. Rep. of Germany | 72/268 |
| 0041014 | 4/1981 | Japan | 72/262 |
| 59-215211 | 12/1984 | Japan . | |
| 60-46810 | 3/1985 | Japan . | |
| 0135415 | 6/1986 | Japan | 72/268 |
| 2081153 | 2/1982 | United Kingdom . | |

*Primary Examiner*—David Jones
*Attorney, Agent, or Firm*—Helfgott & Karas

[57] ABSTRACT

A two wheel type continuous extrusion apparatus has two rotary wheels having grooves receiving covering material rods, a fixed shoe block arranged therebetween and an abutement receiving a core metal wire. Covering material inlet apertures are provided for communicating passage-ways receiving the covering material rods to a covering chamber for extruding the covering material on the core metal wire to manufacture a composite metal wire. The covering material inlet apertures are inclined relative to a line connecting rotary axes of the rotary wheels such that the covering chamber is positioned on the side of supplying of the covering material rods relative to the connecting line. Consequently, a constraining force for constraining a shoe block becomes small.

7 Claims, 5 Drawing Sheets

METHOD AND APPARATUS FOR MANUFACTURING A COMPOSITE METAL WIRE BY USING A TWO WHEEL TYPE CONTINUOUS EXTRUSION APPARATUS

FIELD OF THE INVENTION

The invention relates to a method and an apparatus for manufacturing a composite metal wire by using a two wheel type continuous extrusion apparatus, and more particularly, to the improvement in which the position of covering material inlet apertures is optimized.

BACKGROUND OF THE INVENTION

A conventional apparatus for manufacturing a composite metal wire by using a two wheel type continuous extrusion apparatus comprises two rotary wheels having grooves on the outer periphery thereof, provided symmetrically relative to an extruding direction of the composite metal wire, a fixed shoe block having an arc-edge surface for closing partially the grooves of the rotary wheels to provide two passage-ways, a nipple having an aperture through which a core metal wire is supplied, two position-changeable abutments each pressed into the groove of the corresponding rotary wheel to close the passage-way, and two adjusting bolts each adjusting a contact pressure of the corresponding abutment to the corresponding rotary wheel, wherein the shoe block is provided with a die which is positioned on the side of extruding the composite metal wire in a covering chamber which is defined between the die and the nipple and communicates with the two passage-ways.

In operation, two aluminum rods are supplied into the two passage-ways, respectively, while the two rotary wheels are rotated to apply a dragging force to the two aluminum rods, so that the supply of plasticized aluminum to the covering chamber is interrupted by the abutments, in which a steel core wire supplied from the nipple is coated with the plasticized aluminum to be extruded from the die.

Thus, a composite metal wire having the steel core wire coated with a covering layer of aluminum is manufactured by using the two wheel type continuous extrusion apparatus.

In this two wheel type continuous extrusion apparatus, the covering chamber is connected via covering material inlet apertures to the passage-ways, wherein the covering material inlet apertures are provided vertical to the extrusion direction of the composite metal wire to be positioned on a line connecting the rotary axes of the rotary wheels.

In another conventional apparatus for manufacturing a composite metal wire by using a two wheel type continuous extrusion apparatus, a covering chamber is provided on the opposite side of supplying covering material rods relative to the line connecting the rotary axes of the rotary wheels, such that the covering material inlet apertures are inclined relatively to the extrusion direction of the composite metal wire. In addition, the combination of abutments and a nipple is replaced by an abutment which is formed with a nipple in an integral manner.

According to the former conventional apparatus for manufacturing a composite metal wire, however, there is a disadvantage in that it is difficult to suppress the amount of the burr formation, when it is increased due to the abrasion, the deformation, etc. of parts of the apparatus such as the rotary wheels, because the position change of the abutments is small, which results in unsufficient adjustment which cannot provide a predetermined seal effect between the grooves of the rotary wheels and the abutments. Consequently, the parts must be replaced earlier by new ones. This results in a troublesome and more frequent disassembling operation of the fixed shoe block, the position-changeable abutments, etc. Further, there is a disadvantage in that the dimension precision of the parts which is required to manufacture a composite metal wire having a predetermined precision which is sought by experiments, so that it takes a long time to adjust the apparatus appropriately. Still further, there is a disadvantage in that a pull-in force (a horizontal component force) of the fixed shoe block, caused by the rotation of the rotary wheels is directly applied to the adjusting bolts and a support block for supporting the adjusting bolts, so that the mechanical strength of the support block must be large.

On the other hand, the latter conventional apparatus for manufacturing a composite metal wire by using a two wheel type continuous extrusion apparatus is more practical than the former conventional one, because the sealing contact pressure is easily adjusted therein, for the reason that the two separate abutments are largely changed in position, and because the dimension precision of the parts can be relieved to some extent. However, there is a disadvantage in that a force for sustaining the abutments must be large, because the covering material inlet apertures are inclined on the opposite side of the covering material supplying rods relatively to the rotary axis connecting line of the rotary wheels. Further there is a disadvantage in that apparatus cost becomes high, because the total configuration of the fixed shoe block and the abutments becomes large in an integral block, and is therefore divided to be assembled by two sections. As a matter of course, the assembling and disassembling operation of the two-divided sections is required, which results in the necessity of the use of a longer time and skilled workers.

SUMMARY OF THE INVENTION

Accordingly, it is an object of the present invention to provide a method and an apparatus for manufacturing a composite metal wire by using a two wheel type continuous extrusion apparatus in which a seal contact pressure is easily adjusted between each groove of the rotary wheels and each pressure surface of the abutment portions.

It is a further object of the invention to provide a method and an apparatus for manufacturing a composite metal wire by using a two wheel type continuous extrusion apparatus in which the dimension precision of parts is relieved.

It is a still further object of the invention to provide a method and an apparatus for manufacturing a composite metal wire by using a two wheel type continuous extrusion apparatus in which handling of assembling and disassembling of the apparatus is made easier.

According to a feature of the invention, a method for manufacturing a composite metal wire by using a two wheel type continuous extrusion apparatus, comprises the steps of:

providing two rotary wheels each having an endless groove on an outer periphery thereof;

providing a fixed shoe block having two portions facing said grooves of said two rotary wheels to define two passage-ways and a die for extruding said composite metal wire;

providing an abutment block having two portions for closing said two passage-ways and a nipple for supplying a core metal wire;

defining two covering material inlet apertures communicated with said two passage-ways between said fixed shoe block and said abutment block, and a covering chamber including said die and said nipple and communicating with said two covering material inlet apertures;

rotating said two rotary wheels in predetermined opposite directions at a predetermined speed;

supplying two covering material rods to said two passage-ways to be plasticized therein by a pressure increase and supplying said core metal wire through said nipple to said covering chamber to extrude said composite metal wire from said die, said composite metal wire comprising said core metal wire and a covering material layer extruded on said core metal wire in accordance with plasticized deformation of said covering material rods; and generating a pull-in force of said fixed shoe block, and a reaction force resulted from a power of said two rotary wheels equivalent to an extrusion pressure by said rotating of said two rotary wheels, wherein a horizontal component of said pull-in force is reverse in vector to a horizontal component of said reaction force.

According to another feature of the invention, an apparatus for manufacturing a composite metal wire by using a two wheel type continuous extrusion apparatus, comprises:

two rotary wheels each having an endless groove on an outer periphery, the grooves being provided symmetrically in a direction of extruding said composite metal wire;

a fixed shoe block having two portions facing said two grooves of said two rotary wheels to define two passage-ways and a die for extruding said composite metal wire, covering material rods being supplied to said two passage-ways;

an abutment block having two portions for closing said two passage-ways and a nipple for supplying said composite metal wire; and two covering material inlet apertures defined between said fixed shoe block and said abutment block to communicate said two passage-ways with a covering chamber including said nipple and said die, wherein said two covering material inlet apertures are inclined relatively to a line connecting the rotary axes of said two rotary wheels at a predetermined angle, thereby providing said covering chamber to be positioned on a side of supplying the covering material rods relative to said line.

BRIEF DESCRIPTION OF THE DRAWINGS

The invention will be described in more detail in conjunction with appended drawings, wherein.

DESCRIPTION OF THE PREFERRED EMBODIMENTS

Before explaining an apparatus for manufacturing a composite metal wire by using a two wheel type continuous extrusion apparatus of a preferred embodiment of the invention, the aforementioned conventional apparatus for manufacturing a composite metal wire by using a two wheel type continuous extrusion apparatus will be explained in FIGS. 1 and 2.

Figure 1:
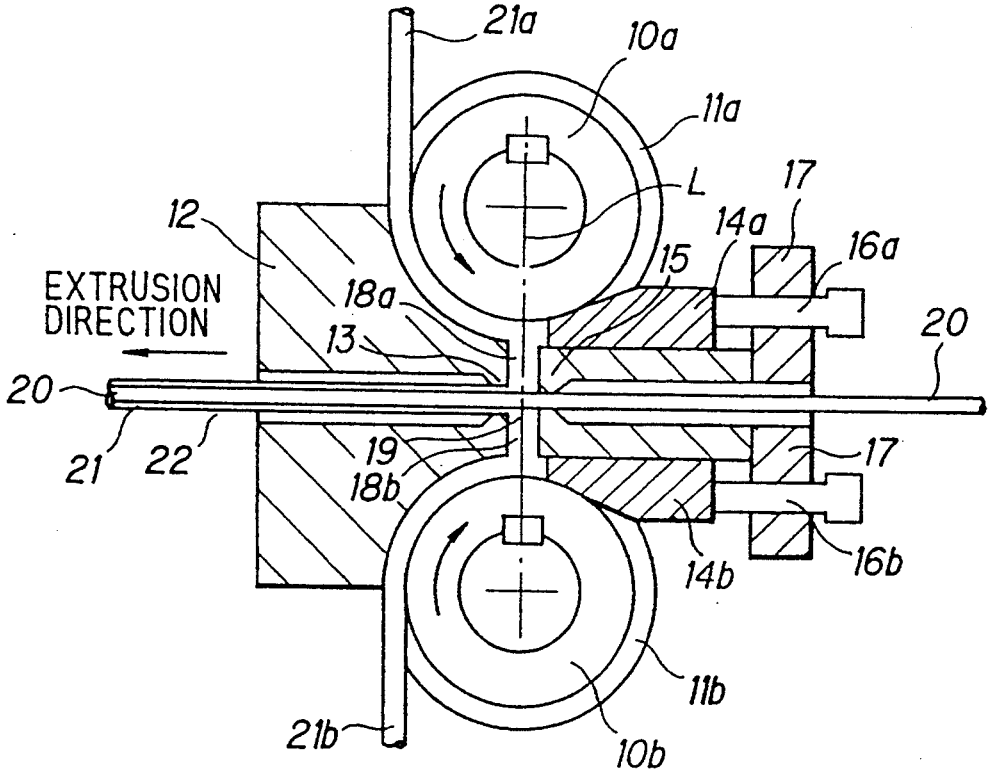
FIG.1 PRIOR ART
FIG. 1 is a cross sectional view showing a conventional apparatus for manufacturing a composite metal wire by using a two wheel type continuous extrusion apparatus.

FIG. 1 shows the first conventional apparatus for manufacturing a composite metal wire by using a two wheel type continuous extrusion apparatus which comprises rotary wheels 10*a* and 10*b* having grooves 11*a* and 11*b* on the outer peripheries, a fixed shoe block 12 having a die 13 provided to define passage-ways along portions of the grooves 11*a* and 11*b* of the rotary wheels 10*a* and 10*b*, abutments 14*a* and 14*b* for closing the passage-ways in accordance with the pressure contact to the rotary wheel grooves 11*a* and 11*b*, a nipple 15 through which a core metal wire 20 is supplied, a support block 17 for constraining the abutments 14*a* and 14*b*, and bolts 16*a* and 16*b* for adjusting the position of the abutments 16*a* and 16*b*. In this apparatus, covering material inlet apertures 18*a* and 18*b* and a covering chamber 19 are defined between the fixed shoe block 12 and the nipple 15, such that they are positioned on a line L which connects rotary axes of the rotary wheels 10*a* and 10*b*.

In manufacturing a composite metal wire 22, covering material rods (for instance, aluminum) 21*a* and 21*b* are supplied along the rotary wheel grooves 11*a* and 11*b* via the passage-ways and the covering material inlet apertures 18*a* and 18*b* to the covering chamber 19, in which the plasticized covering material applies pressure on the outer surface of the core metal wire (for instance, steel) 20, so that a composite metal wire 22 is extruded from the die 13. In this apparatus, the seal contact pressure of the abutments 14*a* and 14*b* on the inner surfaces of the rotary wheel grooves 11*a* and 11*b* is adjusted in accordance with the position shift of the abutments 14*a* and 14*b* carried out in the extrusion direction and the reverse direction thereof by the bolts 16*a* and 16*b*.

Figure 2:
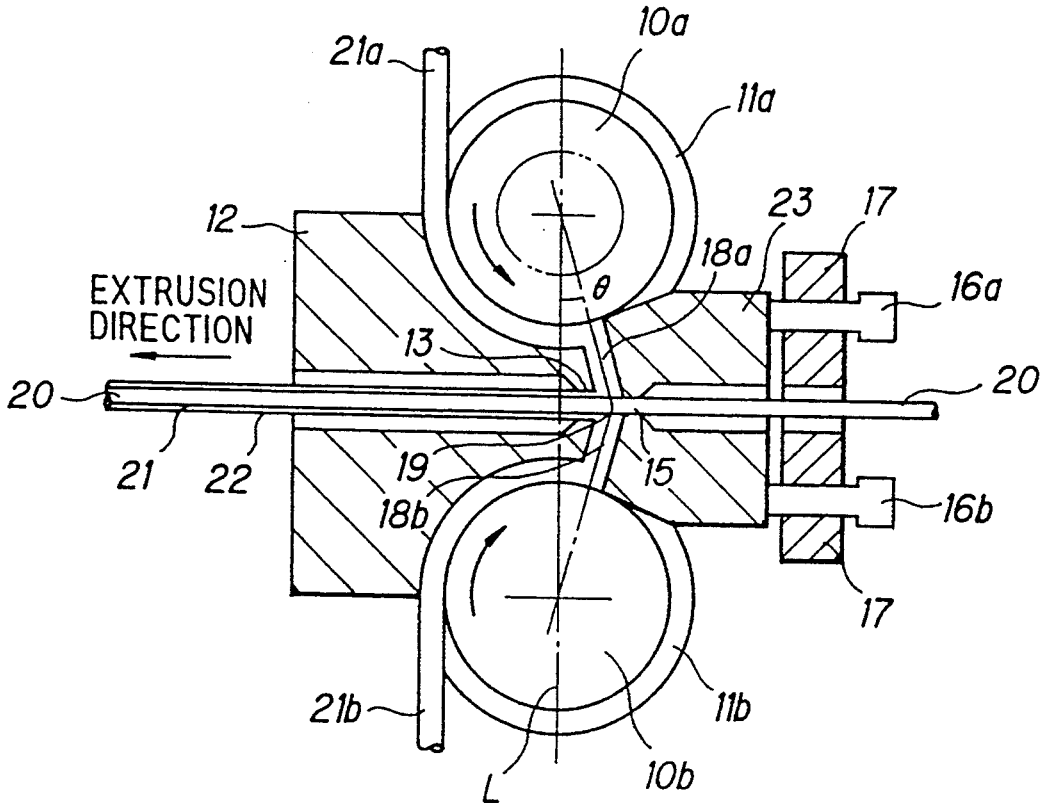
FIG.2 PRIOR ART
FIG. 2 is a cross sectional view showing another conventional apparatus for manufacturing a composite metal wire by using a two wheel type continuous extrusion apparatus.

FIG. 2 shows another conventional apparatus for manufacturing a composite metal wire by using a two wheel type continuous extrusion apparatus, wherein like parts are indicated by like reference numerals as used in FIG. 1.

In this apparatus, covering material inlet apertures 18a and 18b are inclined relative to line L connecting the rotary axes of the wheels 10a and 10b, by an angle $\theta$, such that covering chamber 19 is positioned on the opposite side of the supply of the covering material rods 21a and 21b relative to the connecting line L. In addition, nipple 15 is defined by an abutment 23, such that the horizontal position shift of the abutment 23 may be different in amount to adjust not only a horizontal pressure but also a vertical pressure.

In accordance with the abovedescribed conventional apparatus for manufacturing a composite metal wire by using a two wheel type continuous extrusion apparatus, however, the aforementioned disadvantages are resulted.

Next, an apparatus for manufacturing a composite metal wire by using a two wheel type continuous extrusion apparatus of a preferred embodiment of the present invention will be explained in reference to FIG. 3, wherein like parts are indicated by like reference numerals as used in FIGS. 1 and 2.

In the apparatus of the present invention, covering material inlet apertures 18a and 18b are inclined relative to the connecting line L in which connects the rotary axis of wheels 10a and 10b, the opposite direction to that in FIG. 2 by an angle $\theta$, such that covering chamber 19 is positioned on the side of supplying of the covering material rods 21a and 21b relative to the connecting line L. In addition, the support block 17 is provided to adjust the position of fixed shoe block 25 by using bolts 16a and 16b, and heat proof alloy ring members 26a and 26b are provided on the inner surface of the covering material inlet apertures 18a and 18b. The shoe block 25 and the abutment block 24 are preferably one integral block.

Figure 4:
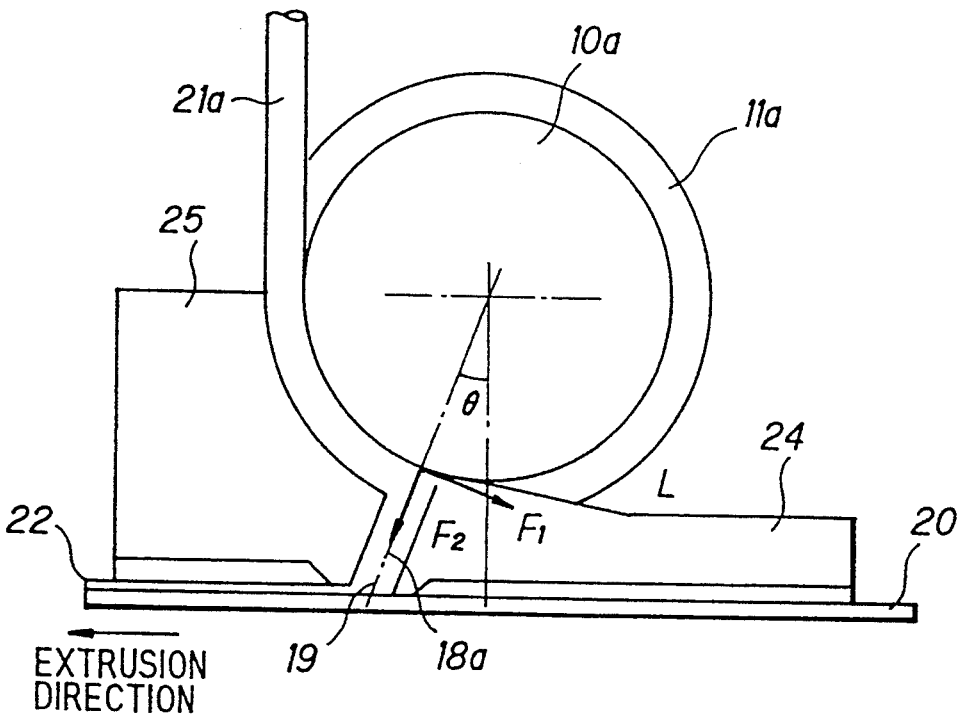
FIG. 4 is a cross sectional view showing an enlarged main portion of the preferred embodiment of the apparatus for manufacturing a composite metal wire by using a two wheel type continuous extrusion apparatus.

Next, various forces acting on parts of the apparatus for manufacturing the composite metal wire 22 by using a two wheel type continuous extrusion apparatus will be explained. In FIG. 4, a pull-in force $F_1$ for pulling the fixed shoe block 25 into the vector direction in accordance with the rotation of the rotary wheel 10a, and a reaction force $F_2$ caused by a power (extrusion force) of the rotary wheel 10a are shown.

The relation of the forces $F_1$ and $F_2$ and a constraining force $F_0$ for constraining the fixed shoe block 25 will be explained in reference to FIGS. 5A to 5D, wherein each vector is shown to be positive in the direction opposite to the extrusion direction and negative in the extrusion direction.

Figure 5A:
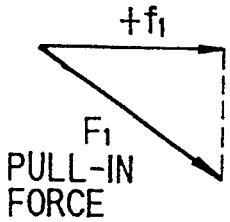
FIGS. 5A to 5D are vector diagrams showing each force acting in the preferred embodiment of the apparatus for manufacturing a composite metal wire by using a two wheel type continuous extrusion apparatus.
Figure 5B:
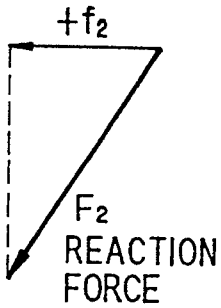
Figure 5C:
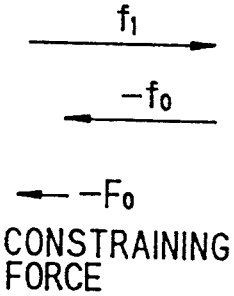
Figure 5D:
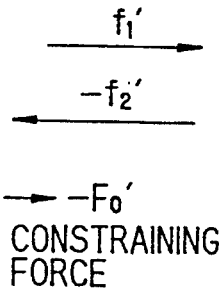

The constraining force $F_0$ has the same magnitude as a combined force of a vertical component $f_1$ of the pull-in force $F_1$ and that of the reaction force $F_2$, and a reversely directional vector relative to the direction of the combined force. If it is assumed that the pull-in force $F_1$ and the reaction force $F_2$ have vectors as shown in FIGS. 5A and 5B, the constraining forces $F_0$ will be a negative value as shown in FIG. 5C or a positive value as shown in FIG. 5D.

Figure 6:
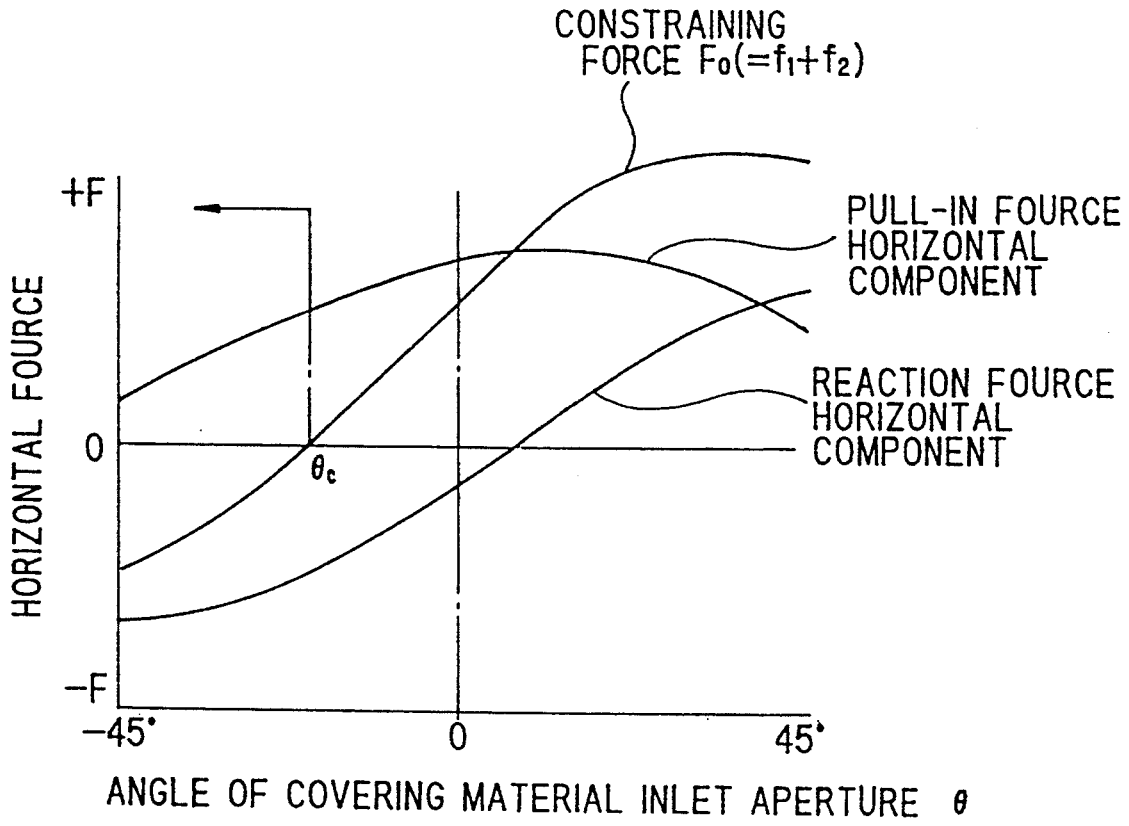
FIG. 6 is a graph explaining a relation between an angle of covering material inlet apertures and each acting force in the preferred embodiment of the apparatus for manufacturing a composite metal wire by using a two wheel type continuous extrusion apparatus.

FIG. 6 shows a force F acting in the horizontal direction relative to an angle $\theta$ with which the covering material inlet aperture 18a is defined relative to the connecting line L, wherein the force F is positive in the extrusion direction, and the angle $\theta$ is positive in the counter-clockwise direction, so that the angle $\theta$ is negative in the preferred embodiment.

As understood from the curves represented in FIG. 6, the horizontal component $f_1$ of the pull-in force $F_1$ acts constantly in the positive direction regardless of the defined angle $\theta$ of the covering material inlet aperture 18a, and is the maximum value in the vicinity of the angle $\theta$ (0°), and the horizontal component $f_2$ of the reaction force $F_2$ is approximately negative in the region where the angle $\theta$ is negative, and positive in the region where the angle $\theta$ is positive, wherein the absolute value thereof is proportional to the absolute value of the angle $\theta$.

The constraining force $F_0$ which is the combined force of the horizontal forces $f_1$ and $f_2$ becomes zero at a predetermined negative angle $\theta_c$, while it becomes a negative value on the negative side of the angle $\theta_c$, and a positive value on the positive side thereof. Even worse, the constraining force $F_o$ becomes large as the angle $\theta$ is increased in the positive direction. For this reason, the angle $\theta$ is set to be approximately the angle $\theta_c$ in the preferred embodiment, so that the constraining force $F_o$ becomes zero or a relatively small value to make the position shift of the fixed shoe block 25 possible by a small external force. As a matter of course, a minute position adjustment can be also made easily. When the angle $\theta$ is on the negative side of the angle $\theta_c$, the combined force is negative, while the constraining force $F_o$ is positive, so that the position adjustment of the fixed shoe block 25 can be carried by an external force applied in the direction opposite to the extrusion direction.

In manufacturing of the composite metal wire 22 in which the steel core wire 20 is covered with the aluminum covering layer 21, it is assumed in a first instance that the angle $\theta$ is $-25°$, that is, the covering material inlet apertures 18a and 18b are inclined on the side of supplying of the covering material rods 21a and 21b relative to the connecting line L by 25°. In this instance, the constraining force $F_o$ is measured to be approximately 5 tons. On the other hand, the constraining force $F_o$ is 40 tons in the conventional apparatus as shown in FIG. 1, wherein each 20 tons are required for the abutments 14a and 14b. As apparent from the comparison of these measured constraining forces $F_0$, the constraining force $F_o$ is much decreased in the apparatus invention.

When the negative angle $\theta$ becomes larger in absolute value than the above specified angle, a horizontal component $f_1$ of the pull-in force $F_1$ is always smaller than a horizontal component $f_2$ of the reaction force $F_2$, so that a required constraining force $F_o$ is always reverse to the extrusion direction. As a result, no constraining means is required on the side of supplying the core metal wire 20, and a support mechanism for constraining the fixed shoe block 25 (which may be integral with the abutment 24) is only provided on the side of extruding of the composite metal wire 22. Accordingly, the position adjustment of the fixed shoe block 25, and the pressure adjustment of the abutment 24 on the grooves 11a and 11b of the rotary wheels 10a and 10b becomes extremely easy.

In this preferred embodiment, the heat-proof alloy rings 26a and 26b are provided on the inner surfaces of the covering material inlet apertures 18a and 18b, so that they are protected thereby from abrasion and deterioration caused by high temperature which is generated by abrasion with the covering material rods 21a and 21b in the passage-ways defined between the rotary wheels 10a and 10b and the fixed shoe block 25. The heat-proof alloy rings 26a and 26b may made of, for instance, Inconel (Trademark) which is one of nickel based heat-proof alloys.

In the invention, a composite metal wire may be modified in material and construction. For instance, a core metal wire may be in construction of a metal wire having an axial bore, a stranded wire, a wire having gaps, a wire insulated by a continuous insulation, or a non-continuous insulation, etc.

In the preferred embodiment, the angle $\theta$ may be set to be $-15°$ for the covering material inlet apertures 18a and 18b, through which aluminum is supplied to the covering chamber 19 to manufacture the composite metal wire 22 having steel wire 20 and aluminum covering layer 21. In this instance, the following parameters are adopted.

| PARAMETER | EXAMPLE 1 | EXAMPLE 2 |
|---|---|---|
| ROTARY WHEEL OUTER DIAMETER | ϕ440 mm | ϕ440 mm |
| ALUMINIUM COVERING MATERIAL ROD DIAMETER | ϕ9.5 mm | ϕ9.5 mm |
| STEEL CORE WIRE DIAMETER | ϕ6.6 mm | ϕ2.1 mm |
| ALUMINIUM COVERED COMPOSITE WIRE DIAMTER | ϕ7.6 mm | ϕ3.4 mm |
| ALUMINIUM COVERING LAYER THICKNESS | 0.5 mm | 0.65 mm |
| ROTARY WHEEL REVOLUTION NUMBER | 7.3 rpm | 5.5 rpm |
| STEEL CORE WIRE PRE-HEAT TEMPERATURE | 400° C. | 400° C. |
| STEEL CORE WIRE FRONT TENSION | 2,000 kg | 350 kg |
| YIELD OF ALUMINIUM COVERING MATERIAL | 95% | 93% |

As apparent from the above table, the steel core wire 20 is pre-heated prior to the supply to the covering chamber 19, and is applied with a front tension which is generated, for instance, by a winding drum which is installed at a stage following the two wheel type continuous extrusion apparatus.

Consequently, the yield of the aluminum covering material is 95% in the Example 1, and 93% in the Example 2. This means that the yield is largely improved in the invention as compared to the conventional apparatus as shown in FIG. 1 in which the yield is approximately 80 to 85%.

Figure 3:
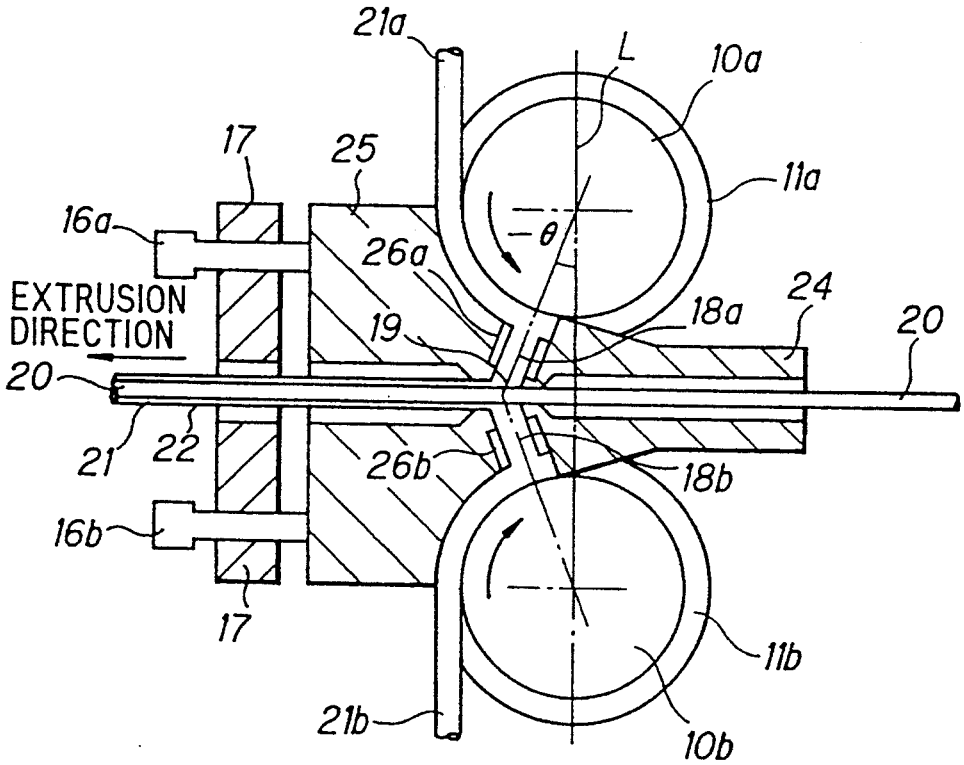
FIG. 3 is a cross-sectional view showing an apparatus for manufacturing a composite metal wire by using a two wheel type continuous extrusion apparatus of a preferred embodiment according to the invention.

In the modification of the apparatus as shown in FIG. 3, the abutment block 24 may have a die, and the shoe block may have a nipple, so that the extrusion direction becomes reverse.

Although the invention has been described with respect to specific embodiment for complete and clear disclosure, the appended claims are not to be thus limited but are to be construed as embodying all modifications and alternative constructions that may occur to one skilled in the art which fairly fall within the basic teaching herein set forth.

What is claimed is:

1. An apparatus for manufacturing a composite metal wire by using a two wheel type continuous extrusion apparatus, comprising:

two rotary wheels each having an endless groove on an outer periphery thereof, endless grooves of said two rotary wheels being formed symmetrically relative to a direction of extruding of said composite metal wire;

a fixed shoe block having two portions facing said grooves of said two rotary wheels, respectively, to define two passage-ways and a die for extruding said composite metal wire, said two passage-ways receiving covering material rods supplied thereto;

an abutment block having two portions for closing said two passage-ways and a nipple for supplying a core metal wire;

a covering chamber including said nipple and said die;

two covering material inlet apertures defined between said fixed shoe block and said abutment block for communicating said two passage-ways to said covering chamber including said nipple and said die; and means for adjusting said fixed shoe block at a predetermined position with respect to said two rotary wheels, wherein said two covering material inlet apertures are inclined relative to a line connecting rotary axes of said two rotary wheels in directions reverse to directions of rotation of said two rotary wheels, respectively, by an angle ranging between 10° and 40°, and said adjusting means is positioned to act against said fixed shoe block in a direction opposite to said direction of extrusion of said composite metal wire.

2. An apparatus for manufacturing a composite metal wire by using a two wheel type continuous extrusion apparatus according to claim 1, wherein:

said adjusting means comprises a support block for constraining said fixed shoe block at said predetermined position, and bolts screwed in said support block for providing said adjustment of said fixed shoe block.

3. An apparatus for manufacturing a composite metal wire by using a two-wheel type continuous extrusion apparatus according to claim 1, wherein said abutment block and said fixed shoe block are formed of one integral body.

4. An apparatus for manufacturing a composite metal wire by using a two wheel type continuous extrusion apparatus according to claim 2, wherein said support block is separated from said fixed shoe block and said bolts are in contact with said fixed shoe block.

5. A method for manufacturing a composite metal wire by using a two wheel type continuous extrusion apparatus, comprising the steps of:

providing two rotary wheels each having an endless groove on an outer periphery thereof;

providing a fixed shoe block having two portions facing grooves of said two rotary wheels to define two passage-ways and a die for extruding a composite metal wire;

providing an abutment block having two portions for closing said two passage-ways, and a nipple for supplying a core metal wire;

defining two covering material inlet apertures communicating with said two passage-ways and a covering chamber including said die and said nipple and communicating with said two covering material inlet apertures between said fixed shoe block and said abutment block;

rotating said two rotary wheels in predetermined opposite directions at a predetermined speed;

supplying two covering material rods to said two passage-ways to be plasticized therein by pressure increase and supplying said core metal wire through said nipple to said covering chamber to extrude from said die a composite metal wire comprising said core metal wire and a covering material layer extruded on said core metal wire in accordance with plasticized deformation of said covering material rods;

generating a pull-in force of said fixed shoe block and a reaction force resulted from a power of said two rotary wheels equivalent to an extrusion pressure by said rotating step of said two rotary wheels, horizontal components of said pull-in force and said reaction force being reverse in vectors; and providing means for adjusting said fixed shoe block at a predetermined position with respect to said rotary wheels, said adjusting means being provided so as to act against a force obtained by combining said horizontal components.

6. A method for manufacturing a composite metal wire by using a two wheel type continuous extrusion apparatus according to claim 5, wherein:

said defining step of said two covering material inlet apertures comprises providing that said two covering material inlet apertures are inclined in reverse directions to rotating directions of said two rotary wheels, respectively, by an angle ranging from 10° to 40° relative to a line connecting rotary axes of said two rotary wheels.

7. A method for manufacturing a composite metal wire by using a two wheel type continuous extrusion apparatus according to claim 5, wherein:

said step of providing an adjustment means comprises providing bolts screwed in a support block to said fixed shoe block against said force obtained by combining said horizontal components.

* * * * *